United States Patent [19]

Thornton et al.

[11] Patent Number: 4,895,401

[45] Date of Patent: Jan. 23, 1990

[54] CABINET DOOR FASTENER

[75] Inventors: James C. Thornton, Welcome Lodge, Black Beck Wood, Bowness on Windermere, Cumbria, LA23 3LS; James R. Marsden, Bowness on Windermere, both of England

[73] Assignee: James C. Thornton, Cumbria, England

[21] Appl. No.: 94,806

[22] Filed: Sep. 10, 1987

[51] Int. Cl.[4] ..... E05C 1/02

[52] U.S. Cl. ..... 292/254; 292/DIG. 37

[58] Field of Search ..... 292/94, 254, 341.14, 292/DIG. 37, DIG. 65; 70/360

[56] References Cited

U.S. PATENT DOCUMENTS

| | | | |
|---|---|---|---|
| 419,881 | 1/1890 | Proctor | 292/254 X |
| 462,658 | 11/1891 | Baier | 292/254 |
| 529,606 | 11/1894 | Davis | 292/254 X |
| 3,980,326 | 9/1976 | Smith | 292/87 |
| 4,109,950 | 8/1978 | Amdal | 292/254 |

FOREIGN PATENT DOCUMENTS

| | | | |
|---|---|---|---|
| 659426 | 10/1951 | United Kingdom | 292/254 |

*Primary Examiner*—Richard E. Moore

[57] ABSTRACT

An improved door opener and latch device consisting of a spring-loaded bolt for holding the door in a closed position when disposed in a keeper assembly, and a release member which may be extended into and through the assembly to eject the bolt therefrom, and allow the door to open.

2 Claims, 2 Drawing Sheets

CABINET DOOR FASTENER

TECHNICAL FIELD

The invention relates to devices for fastening furniture such as cabinets, doors and windows, in such a way as to make them releasable by mechanism which can be concealed, for example from a child.

BACKGROUND ART

A door is customarily held in a closed position by a bolt carried by the door engaging with a keeper on a frame surrounding the door. The bolt may be spring loaded, and provided with a rounded or inclined end for engagement with the keeper so as to enable the door to be fastened without manual operation of any handle. Such doors can often be opened by a simple application of manual force, and so leave the contents of any cabinet available to a child or even a pet. This can be dangerous in the case of household chemicals or alcoholic drink, drugs or medicines.

THE INVENTION

The invention provides a fastening and releasing device for a door comprising a casing containing a spring-loaded bolt spaced by some distance from the door, and a releasing device which comprises a keeper for the bolt, and a release member contactable with an end of the bolt and slidable in relation to the keeper to release the bolt, the release member having a head at an end remote from the bolt so that pressure on the head in the direction of the bolt releases the bolt. The release member will fall back to an inoperative position under gravity. The keeper is preferably part of an assembly comprising also a striker plate. A lid may be provided to cover an aperture in the striker plate/keeper assembly in which the bolt is receivable.

The head may be integral with or separate from the remainder of the release member. A longitudinal slot and a key slidable therein may be provided respectively on the release member or its head and a mounting for the keeper adjacent which the member is slidable, or on the release member and head, so that the releasing device can only be operated when the relevant two components are in an appropriate mutual orientation.

The releasing device may generally be mounted in a bottom member of a door frame, and may be concealed by an edge of the door extending beyond the frame. Thus, the device may be actuated by a toe, and can be used in kitchen floor-units.

The releasing device may be pressed from sheet metal or injection moulded in two or more pieces from nylon or polypropylene for example. The device may be sold with matching spring-loaded bolt as a kit of parts for use on a cabinet, door or window. The device may be fitted to new cabinets by professionals or fitted to existing cabinets by do-it-yourself persons.

A modified form of the device may be made totally concealable in a wall of a cabinet. The device may be designed so as to fit entirely in a hole cut through the cabinet wall. To this end, the releasing device itself would fit closely in the hole, and be dimensioned so that the head of the release member does not project from the wall, but is actuable by finger pressure on a preferably concave button. This form of the device would not be seen at all from outside the cabinet. Alternatively, the release member may be made long enough to pass through any board of which a shelf or frame member is likely to be made, and may be cut off on installation flush with the remote side of the board.

DRAWINGS

FIG. 1 is a section through a spring-loaded bolt suitable for use with a releasing device according to the invention;

FIG. 2 elevation of the bolt of FIG. 1;

Figure 4:
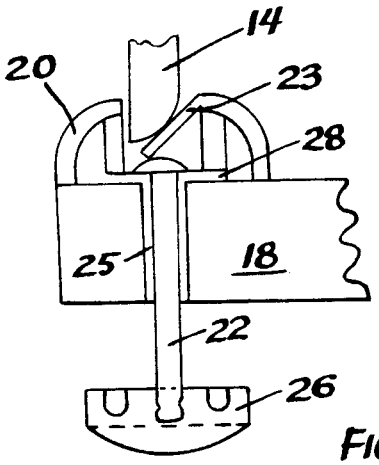
FIG. 4 is a section through a releasing device useful in conjunction with of FIGS. 1 to 3 in closed position.
Figure 5:
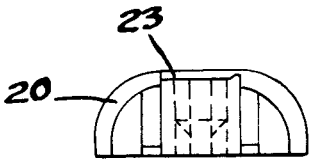
Figure 6:
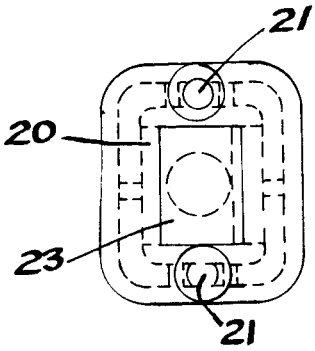

FIG. 5 a section corresponding to the upper part of FIG. 4 but in an position; and FIG. 6 is a top plan view of the releasing device corresponding to FIG. 5.

BEST MODE

Figure 1:
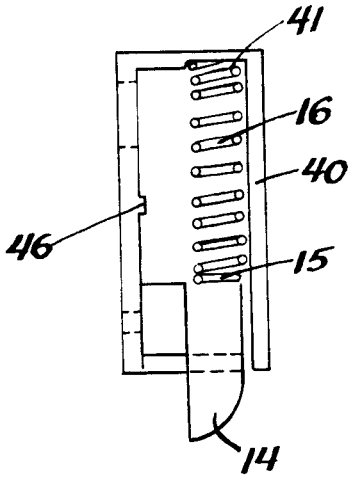
Figure 2:
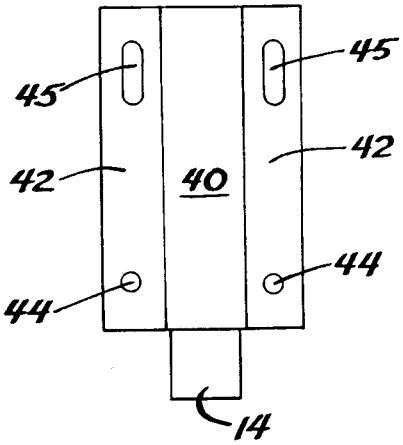
Figure 3:
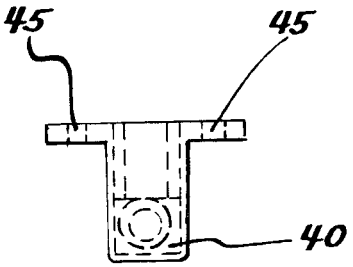
FIG. 3 is a top plan of the bolt of FIG. 1.

FIG. 1 shows a bolt 14 loaded by a spring 16 in a casing 40. The casing 40 is provided with laterally-projecting flanges 42 (FIG. 2) for attachment to a door (not shown). It will be noted that the casing 40 is shaped so that the bolt 14 itself is spaced by some distance from the door to which the casing 40 is to be attached. The flanges 42 are provided with screw-holes 44 and slots 45 for use in attachment to the door. The flanges 42 keep the bolt 14 in a vertical position, and act as a downward stop. The bolt 14 has at its upper end a circular projection 15 which locates a lower end of the spring 16. An upper end of the spring 16 is located in a circular depression 41 in the inside upper end of the casing 40. A ridge 46 is moulded on the inside of the casing 40 as a stop for the upward movement of the bolt 14.

In FIG. 4, the releasing device comprises a striker plate and keeper 20 which in the closed position of FIG. 4 engages the bolt 14. The releasing device is secured to a frame member or shelf 18 by screws passing through counter sunk holes 21 (FIG. 6). The releasing device has radiussed corners, and is provided with support webs on the underside. The releasing device has a central rectangular aperture, closed by a hinged lid 23, for receiving the bolt 14. The lid 23 is held open by the bolt 14 in FIG. 4, and closed by upward movement of a release member 22. The lid 23 is hinged through a thinning from the underside of the plastics material from which it is made integral with the keeper 20.

The release member 22 is a metal rod with a domed head at the top for contacting the underside of the lid 23, and a V-groove near the bottom for securing on a corresponding rib on a moulded plastics actuator button 26. The release member 22 is slidable in a plastic sleeve 25 which has a rectangular flange 28 at an upper end. The sleeve 25 is non-rotatably held in the base of the keeper 20, and received in a hold in the shelf 18. Upward pressure on the actuator button 26 raises the release member 22, which slides in the sleeve 25, and with it the lid 23 and bolt 14, which accordingly is released. On removal of the upward pressure, the release member 22 falls back under gravity, and leaves the lid 23 in the position shown in FIGS. 5 and 6.

I claim:

1. A child-proof cabinet door fastening and releasing device consisting of a spring-loaded bolt in a casing, said casing being adapted for mounting on a cabinet door so that said bolt is in a spaced relationship form said door, and so that said bolt normally projects downwardly on a generally vertical axis; a releasing device attached inside and to the base of a cabinet, comprising a keeper for said bolt and a releasing rod affixed therein and extending through said base, said releasing rod being disposed vertically, aligned axially with said bolt and being slidable in relation to said keeper and base; said releasing rod having a head located at its lower extremity whereby pressure applied upwardly on said head will release the bolt from the keeper.

2. A device according to claim 1 wherein the keeper also comprises a striker plate and a hinged lid to close the opening in which the bolt is receivable.

* * * * *